US006231456B1

(12) United States Patent
Rennie et al.

(10) Patent No.: US 6,231,456 B1
(45) Date of Patent: May 15, 2001

(54) GOLF SHAFT VIBRATION DAMPER

(76) Inventors: Graham Rennie, 53980 Arrowhead Dr., Shelby Township, MI (US) 48315; William J. Sobkow, 9504 Joy Rd., Plymouth, MI (US) 48017

( * ) Notice: Subject to any disclaimer, the term of this patent is extended or adjusted under 35 U.S.C. 154(b) by 0 days.

(21) Appl. No.: 09/286,551

(22) Filed: Apr. 5, 1999

(51) Int. Cl.[7] ..... A63B 53/10; A63B 53/12
(52) U.S. Cl. ..... 473/316; 473/318
(58) Field of Search ..... 473/318, 520, 473/319, 320; 273/80 B, 80 R

(56) References Cited

U.S. PATENT DOCUMENTS

| | | | | |
|---|---|---|---|---|
| 1,125,029 | * | 1/1915 | Lard | 473/316 |
| 1,169,667 | | 1/1916 | Meguyer . | |
| 1,688,473 | | 3/1928 | Sippel . | |
| 1,777,822 | | 10/1930 | Barrett . | |
| 1,968,616 | | 7/1934 | Oldman . | |
| 2,099,319 | | 11/1937 | Shaw . | |
| 3,764,137 | | 10/1973 | Petro . | |
| 3,972,529 | | 8/1976 | McNeil . | |
| 4,023,801 | | 5/1977 | Van Auken . | |
| 4,044,625 | | 8/1977 | Haem et al. . | |
| 4,415,156 | | 11/1983 | Jorgensen . | |
| 4,725,060 | | 2/1988 | Iwanaga . | |
| 4,836,545 | | 6/1989 | Pompa . | |
| 4,951,953 | | 8/1990 | Kim . | |
| 4,979,743 | | 12/1990 | Sears . | |
| 5,083,780 | | 1/1992 | Walton et al. . | |
| 5,203,561 | | 4/1993 | Lanctot . | |
| 5,269,516 | | 12/1993 | Janes . | |
| 5,277,423 | * | 1/1994 | Artus | 273/80 R |
| 5,294,119 | | 3/1994 | Vincent et al. . | |
| 5,297,791 | | 3/1994 | Negishi . | |
| 5,314,180 | | 5/1994 | Yamagishi . | |
| 5,322,280 | | 6/1994 | Wu . | |
| 5,362,046 | | 11/1994 | Sims . | |
| 5,653,643 | * | 8/1997 | Falone et al. | 473/300 |
| 5,655,975 | | 8/1997 | Nashif . | |
| 5,692,971 | * | 12/1997 | Williams | 473/318 |
| 5,902,656 | * | 5/1999 | Hwang | 473/318 |
| 5,944,617 | * | 8/1999 | Falone et al. | 473/300 |

FOREIGN PATENT DOCUMENTS

| | | |
|---|---|---|
| 499155 | 11/1937 | (GB) . |
| 205004 | 6/1980 | (GB) . |
| 2053698 | 7/1980 | (GB) . |
| 2146906 | 3/1984 | (GB) . |
| 2227418 | 1/1990 | (GB) . |
| 2226380 | 6/1990 | (GB) . |

* cited by examiner

*Primary Examiner*—Jeanette Chapman
*Assistant Examiner*—Sneh Varma
(74) *Attorney, Agent, or Firm*—Young & Basile P.C.

(57) ABSTRACT

A vibration damping insert adapted to be positioned within the hollow tubular shaft of a golf club. The insert includes a central rod member sized to fit within the hollow shaft of the club and a plurality of circumferentially spaced fins extending radially outwardly from and substantially coextensive with the rod member, with the fins sized and configured to engage the inner tubular surface of the shaft. The fins form a part of an annular outer body separate from the central rod member and formed of a material having a durometer hardness less than the durometer hardness of the central rod member. The central rod member and annular outer body are preferably formed in a coextrusion process.

20 Claims, 1 Drawing Sheet

FIG - 1
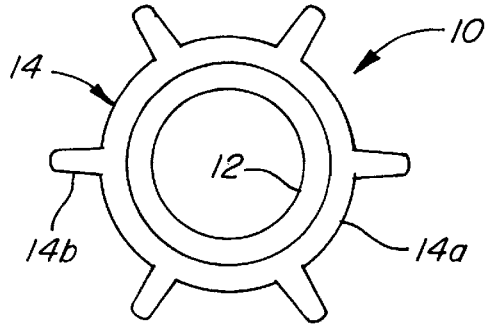
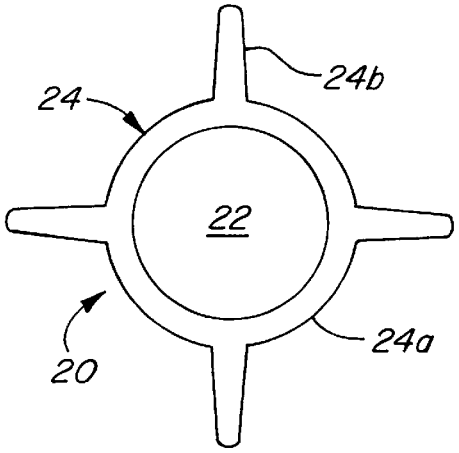
FIG - 2
FIG - 4
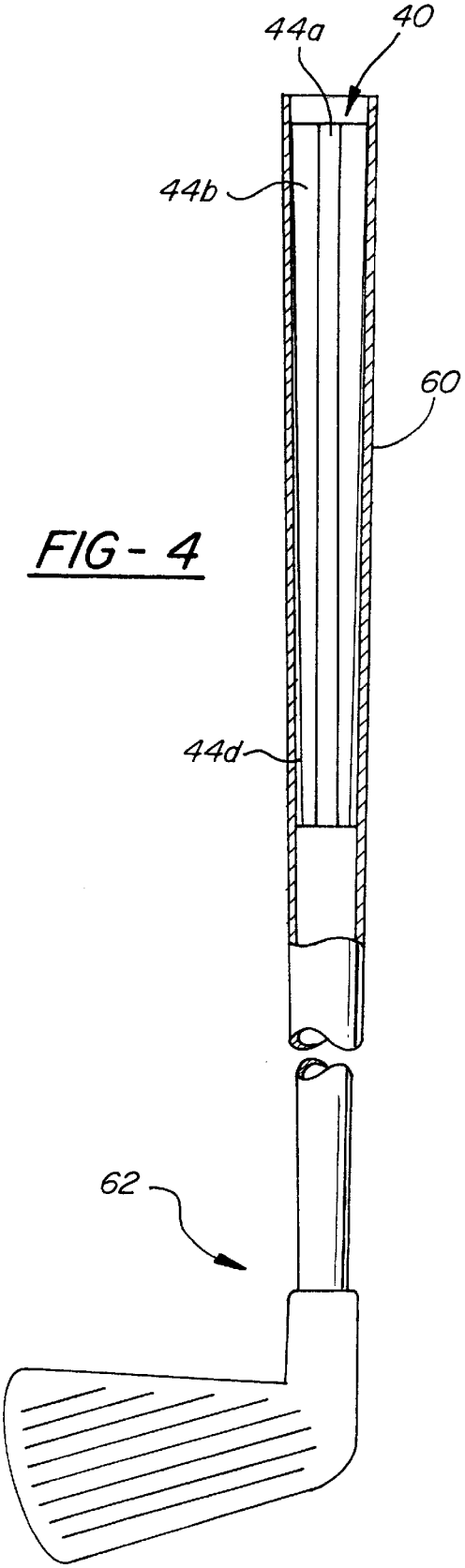
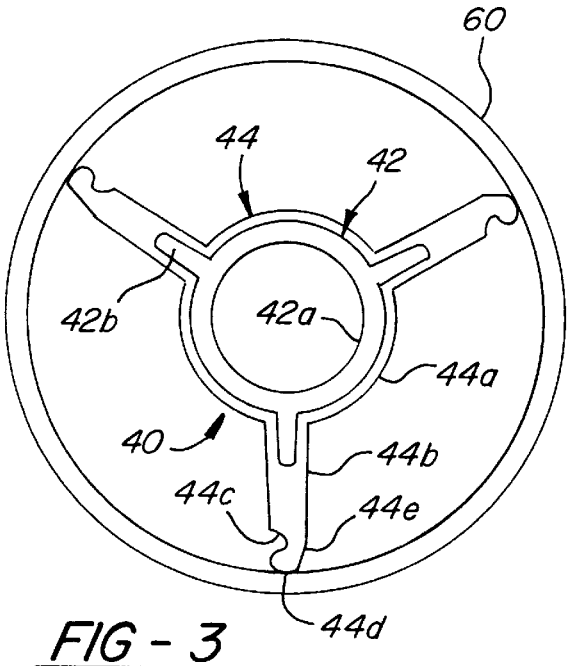
FIG - 3

GOLF SHAFT VIBRATION DAMPER

FIELD OF THE INVENTION

This invention relates generally to sporting equipment. More specifically, the invention relates to golf clubs. Most specifically, the invention relates to a vibration damping insert configured to be inserted into the shaft of a golf club.

BACKGROUND OF THE INVENTION

The shafts of golf clubs are often made from tubular bodies of metal or composite materials. When a ball is struck with the golf club, the shaft is prone to vibration. Such vibrations can influence play of the game, and can also be uncomfortable for the player. As a consequence, various attempts have been made to dampen the vibration of golf club shafts. In some instances, devices or coatings have been applied to the exterior of the shaft. In other instances, insert members are placed within a hollow shaft. One specific insert member comprises a rigid central member having a strip of polymeric foam wound thereabout. Any vibration damping insert should be low in cost, easy to fabricate and simple to use. Also, any vibration damping device should not adversely affect the balance or play of the club.

SUMMARY OF THE INVENTION

The present invention provides a low cost, easy to fabricate and easy to use vibration damping insert which may be utilized with golf club shafts, as well as other shafts and handles or items in which vibration must be damped.

The vibration damping insert of the invention is configured to be disposed within a tubular shaft such as a golf club shaft and includes a central core rod member and a plurality of circumferentially spaced fins extending radially outwardly from and substantially coextensive with the rod member. When inserted into the hollow shaft, the insert serves to effectively dampen vibration transmission to the user upon impact of the club with a golf ball.

According to a further feature of the invention, the central core rod member is formed as a separate member from the fins and is formed of a first material having a relatively high durometer hardness, and the fins are formed of a second material having a relatively low durometer hardness. This dual hardness aspect of the insert facilitates the formation of the insert and augments the damping action of the insert.

According to a further feature of the invention, the insert is formed in an extrusion process in which the second material forming the fins is extruded over the first material forming the central core rod. This specific formation technique facilitates the ready and inexpensive formation of the insert. In the preferred embodiment of the invention, the insert is formed in a coextrusion process in which the fins are extrudingly formed simultaneously with the extruding formation of the central core rod.

According to a further feature of the invention, each fin includes a relatively stiff portion proximate the central core rod and a relatively flexible portion proximate the radially outward end of the fin. This specific construction facilitates the insertion of the insert into the shaft and accommodates the typical tapered configuration of the shaft.

According to a further feature of the invention, the flexible radially outward portion of each fin is delineated and defined by a hinge line proximate the outward portion of the fin about which the fin may readily fold to accommodate the tapered configuration of the shaft.

According to a further feature of the invention, the core rod member includes a tubular main body portion and a plurality of circumferentially spaced lobes extending radially outwardly from the main body portion; the fins form a part of an annular outer body including a tubular main body portion positioned in surrounding relation to the tubular main body portion of the core rod; the fins extend radially outwardly from the outer body main body portion; and each fin extends along and encapsulates a respective lobe and extends radially outwardly beyond the respective lobe. This specific construction facilitates the formation of the insert and augments the damping action of the insert. In the preferred embodiment of the invention, the core rod member has a durometer hardness in the range of 95–100 and the outer body has a durometer hardness in the range of 80–85.

BRIEF DESCRIPTION OF THE DRAWINGS

FIG. 1 is a cross sectional view of a first embodiment of vibration damping insert according to the invention;

FIG. 2 is a cross sectional view of a second embodiment of vibration damping insert according to the invention;

FIG. 3 is a cross sectional view of a third embodiment of vibration damping insert according to the invention; and FIG. 4 is a cross sectional view of a golf club incorporating a vibration damper insert according to the third embodiment of the invention.

DETAILED DESCRIPTION OF THE INVENTION

The present invention is directed to a vibration damping insert for a golf club or other handled implement. The insert comprises a rigid central core, having a first hardness, which is surrounded by a softer, exterior body of material having a second hardness less than the first hardness.

Referring now to FIG. 1, there is shown one embodiment of vibration damping insert 10 according to the invention. The insert 10 of FIG. 1 includes a central core rod 12, which in this embodiment is a hollow or tubular element. Tubular core rod 12 is surrounded by an annular outer body 14. Outer body 14 includes a tubular main body portion 14*a* surrounding and coextensive with tubular core member 12 and a plurality of circumferentially spaced fins 14*b* extending radially outwardly of and coextensive with main body portion 14*a*. Preferably, tubular core rod 12 is fabricated from a relatively hard, stiff material, preferably an organic polymer such as nylon, polyvinylchloride, ABS or the like. Typically, core rod 12 has a durometer hardness rating of approximately 95 to 100. Annular outer body 14 is preferably fabricated from a material which is somewhat softer that the material used for the fabrication of core rod 12. For example, outer body 14 preferably has a durometer hardness in the range of 80–85. Body 14 may be fabricated from any organic polymer compatible with the core rod, and such materials may include polyurethane, synthetic rubbers, copolymers and the like. As illustrated, exterior body 14 includes six fins, although it is to be understood that a larger or smaller number of fins may be employed.

In use, the insert is placed within the shaft of a golf club. The relatively rigid central core rod 12 permits the insert to be pushed, lengthwise, into the club shaft. The softer material of the outer body 14 compresses to some degree, and the fins establish contact with the shaft walls, thereby retaining the insert tightly therein. In the use of the club, the material comprising the insert 10 serves to absorb and dampen shaft vibrations.

The insert 10 of FIG. 1 is most advantageously fabricated by an extrusion process in which outer body 14 is extruded onto core rod 12. The extrusion may be a two step process in which the outer body 14 is applied to a pre-formed core rod. In other instances, the extrusion may be a single step process wherein core rod 12 and exterior body 14 are coextruded. As will be apparent to one of skill in the art, other plastic forming processes may also be employed to manufacture the insert of the present invention.

Referring now to FIG. 2, there is shown another embodiment of insert 20 according to the invention. Insert 20 of FIG. 2 includes a solid core rod 22 of polymeric material and an annular outer body 24. Outer body 24 includes a tubular main body portion 24*a* surrounding and coextensive with solid rod 22 and four circumferentially spaced fins 24*b* extending radially outwardly of and coextensive with main body portion 24*a*. As will be apparent, various numbers of fins may be employed. Further, while the core rods are illustrated herein as being of circular cross section, core rods of other cross sectional shapes may also be employed in the practice of the invention.

Referring now to FIG. 3, there is shown yet another embodiment of vibration damper insert according to the invention. The insert 40 of FIG. 3 includes a central hollow tubular core rod 42 and an annular outer body 44. Core rod 42 is generally similar to the core rod 12 and may preferably be fabricated from a polymeric material. Core rod 42 includes a tubular main body portion 42*a* and a plurality of circumferentially spaced, axially extending lobe portions 42*b*, in this case three equally spaced lobe portions extending the full length of the core rod. Outer body 44 is fabricated from a material which is somewhat softer than the material used to fabricate the core rod. For example, the material of the core rod may have a durometer hardness rating in the range of 95–100 and the material of outer body 44 may have a durometer hardness rating in the range of 80–85. Outer body 44 includes a tubular main body portion 44*a* positioned in surrounding relation to the tubular main body portion 42*a* of the core rod 42 and a plurality of circumferentially spaced fin portions 44*b* equally spaced about the central axis of the insert and each extending along and encapsulating a respective core rod lobe 42*b*. As with the core rod lobes 42*b*, fins 44*b* preferably extend the full length of the insert. Each fin 44*b* extends radially outwardly beyond the associated core lobe 42*b* and further includes an axial indentation 44*c* proximate the outer radial extremity 44*d* of the fin defining a hinge line 44*e* at which the fin will tend to fold over when subjected to radially inward forces. The described construction provides a fin structure in which the portion of each fin proximate the core rod is relatively stiff and the portion of each fin proximate the radially outward end of the fin is relatively flexible. The insert of FIG. 3 is most advantageously fabricated by a co-extrusion process in which the material of outer body 44 is extruded onto the material of core rod 42 as the core rod is being extrudingly formed.

In use, as best seen in FIG. 4, the insert 40 is inserted into the hollow upper end of a tapered handle shaft 60 of a golf club 62. Club 62, in known manner, further includes a head 64 secured to the lower end of hollow shaft 60. As the insert is moved downwardly within the inwardly tapering shaft the fins 44*b* of outer body 44 tend to fold over as the insert encounters successively more narrow shaft diameters with the folding occurring at the hinge lines 44*e* so that, as shown, when the insert is fully inserted into the shaft the fin portions 44*b* at the upper end of the insert may extend substantially fully outwardly but yet maintain contact with the inner diameter of the shaft whereas the fin portions 44*b* at the lower end of the insert may be folded over at the hinge lines so as to allow the insert to move downwardly within the shaft and yet maintain contact with the inner diameter of the shaft throughout the length of the insert. In the use of the golf club, as in previous embodiments, the material comprising the insert serves to absorb and dampen shaft vibrations occurring upon the impact of the head of the club with a golf ball.

While the foregoing insert has been described primarily with regard to golf clubs, it should be apparent to one of skill in the art that the insert may also be utilized, with advantage, in other applications such as tool handles, racket handles, other sporting goods, and the like.

The foregoing drawings, discussion, and description are merely illustrative of particular embodiments of the invention, and are not meant to be limitations upon the practice thereof.

What is claimed is:

1. A vibration damping insert configured to be disposed within a tubular shaft comprising:

a central rod member; and a plurality of circumferentially spaced fins extending radially outwardly from and substantially coextensive with said rod member;

the central rod member being formed as a separate member from the fins and being formed of a first material having a relatively high durometer hardness; and the fins being formed of a second material having a relatively low durometer hardness.

2. A vibration damping insert according to claim 1 wherein the insert is formed in an extrusion process in which the second material forming the fins is extruded over the first material forming the central rod.

3. A vibration damping insert according to claim 2 wherein the insert is formed in a coextrusion process in which the fins are extrudingly formed simultaneously with the extruding formation of the central rod.

4. A vibration damping insert according to claim 1 wherein:

the core rod member includes a tubular main body portion and a plurality of circumferentially spaced lobes extending radially outwardly from the main body portion;

the fins form a part of an annular outer body including a tubular main body portion positioned in surrounding relation to the tubular main body portion of the core rod;

the fins extend radially outwardly from the outer body main body portion; and each fin extends along and encapsulates a respective lobe and extends radially outwardly beyond the respective lobe.

5. A vibration damping insert according to claim 4 wherein the central rod member has a durometer hardness in the range of 95–100 and the outer body has a durometer hardness in the range of 80–85.

6. A vibration damping insert configured to be disposed within a tubular shaft comprising:

a central rod member; and a plurality of circumferentially spaced fins extending radially outwardly from and substantially coextensive with said rod member;

each fin including a relatively stiff portion proximate the central rod and a relatively flexible portion proximate the radially outer end of the fin.

7. A vibration damping insert according to claim 6 wherein the flexible radially outward portion of each fin is delineated and defined by a hinge line proximate the outer end of the fin about which the fin may readily fold.

8. A vibration damping insert configured to be disposed within a tubular shaft comprising:

a central tubular rod member including a tubular main body portion and a plurality of circumferentially spaced lobes extending radially outwardly from the main body portion; and an outer body including a tubular main body portion positioned in surrounding relation to the tubular main body portion of the central rod and a plurality of circumferentially spaced fins extending radially outwardly from the outer body main portion with each fin extending along and encapsulating a respective lobe and extending radially outwardly beyond the respective lobe.

9. A vibration damping insert according to claim 8 wherein:

the central rod member is formed as a separate member from the outer body; and the outer body is formed of a material having a hardness less than the hardness of the material forming the central rod member.

10. A vibration damping insert according to claim 9 wherein the insert is formed in an extrusion process in which the material of the outer body is extruded over the material of the central rod member.

11. A vibration damping insert according to claim 10 wherein the insert is formed in a coextrusion process in which the outer body is extrudingly formed simultaneously with the extruding formation of the central rod member.

12. A vibration damping insert according to claim 8 wherein each fin includes a hinge line radially outwardly of the respective lobe defining a fold line for the portion of the fin radially outwardly of the hinge line.

13. A vibration damping insert according to claim 12 wherein the central member has a durometer hardness in the range of 95–100 and the outer body has a durometer hardness in the range of 80–85.

14. A golf club comprising a hollow handle shaft, a head secured to the lower end of the shaft, and a vibration damping insert positioned within the hollow shaft, characterized in that the insert includes:

a central rod member sized to fit within the shaft of the club; and a plurality of circumferentially spaced fins extending radially outwardly from and substantially coextensive with said rod member, the fins being sized and configured to engage an inner surface of the shaft;

the central rod member including a tubular main body portion and a plurality of circumferentially spaced lobes extending radially outwardly from the main body portion:

the fins forming a part of an annular outer body including a tubular main body portion positioned in surrounding relation to the tubular main body portion of the core rod:

the fins extending radially outwardly from the outer body main body portion: and each fin extending along and encapsulating a respective lobe and extending radially outwardly beyond the respective lobe for engagement with the inner surface of the shaft.

15. A golf club according to claim 14 wherein:

each fin includes a hinge line radially outwardly of the respective lobe defining a fold line for the portion of fin extending radially outwardly of the hinge line.

16. A golf club according to claim 15 wherein the insert is formed in a extrusion process in which the second material forming the fins is extruded over the first material forming the central rod.

17. A golf club according to claim 16 wherein the insert is formed in a coextrusion process in which the outer body is extrudingly formed simultaneously with the extruding formation of the central rod member.

18. A golf club according to claim 17 wherein the central rod member has a durometer hardness in the range of 95–100 and the outer body has a durometer hardness in the range of 80–85.

19. A vibration damping insert configured to be disposed within a hollow shaft of a golf club and including a central rod member and an annular outer body positioned in surrounding relation to the rod member, characterized in that:

the central rod member is formed as a separate member from the annular outer body and is formed of a first material having a relatively high durometer hardness;

the annular outer body is formed of a second material having a relatively low durometer hardness; and the insert is formed in an extrusion process in which the second material forming the annular outer body is extruded over the first material forming the central rod.

20. A vibration damping insert according to claim 19 wherein the insert is formed in a coextrusion process in which the annular outer body is extrudingly formed simultaneously with the extruding formation of the central rod.

* * * * *